US011920300B2

(12) United States Patent
Nakamura et al.

(10) Patent No.: US 11,920,300 B2
(45) Date of Patent: Mar. 5, 2024

(54) FIBER BODY MANUFACTURING APPARATUS, FIBER BODY MANUFACTURING UNIT, AND FIBER BODY MANUFACTURING METHOD

(71) Applicant: SEIKO EPSON CORPORATION, Tokyo (JP)

(72) Inventors: Masahide Nakamura, Matsumoto (JP); Makoto Kawamoto, Matsumoto (JP); Akira Hashimoto, Shiojiri (JP); Naoto Aruga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/809,018

(22) Filed: Jun. 27, 2022

(65) Prior Publication Data

US 2022/0412004 A1 Dec. 29, 2022

(30) Foreign Application Priority Data

Jun. 28, 2021 (JP) ..... 2021-106444

(51) Int. Cl.

| | |
|---|---|
| ***D21F 7/00*** | (2006.01) |
| ***D21F 3/02*** | (2006.01) |
| ***D21F 9/04*** | (2006.01) |
| ***D21F 11/06*** | (2006.01) |

(52) U.S. Cl.

CPC ..... *D21F 7/003* (2013.01); *D21F 3/0272* (2013.01); *D21F 9/046* (2013.01); *D21F 11/06* (2013.01)

(58) Field of Classification Search

CPC ... B27N 3/04; B27N 3/18; D04H 1/60; D04H 1/72; D21F 7/003; D21F 11/00; D21F 3/0272; D21F 9/046; D21F 11/06; D21F 9/00

See application file for complete search history.

(56) References Cited

U.S. PATENT DOCUMENTS

2019/0062996 A1 2/2019 Yoda et al.
2021/0206019 A1* 7/2021 Miyazawa ..... B27N 3/04

FOREIGN PATENT DOCUMENTS

EP 3 418 435 A1 12/2018
JP 2019-044284 A 3/2019

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

There is provided a fiber body manufacturing apparatus including: an accumulating section that forms a web by accumulating a material containing fibers on a first transport belt by a dry method; a transport section that transports the web by peeling off a first surface of the web from the first transport belt, and by bringing a second surface of the web, which is a surface opposite to the first surface peeled off from the first transport belt, into contact with a second transport belt; a water-applying section that applies water toward the first surface of the web in a state where the web is in contact with the second transport belt; and a pressurizing section that pressurizes the web to which the water is applied and which is peeled off from the second transport belt.

6 Claims, 6 Drawing Sheets

FIBER BODY MANUFACTURING APPARATUS, FIBER BODY MANUFACTURING UNIT, AND FIBER BODY MANUFACTURING METHOD

The present application is based on, and claims priority from JP Application Serial Number 2021-106444, filed Jun. 28, 2021, the disclosure of which is hereby incorporated by reference herein in its entirety.

BACKGROUND

1. Technical Field

The present disclosure relates to a fiber body manufacturing apparatus, a fiber body manufacturing unit, and a fiber body manufacturing method.

2. Related Art

In the related art, as described in JP-A-2019-44284, a sheet manufacturing apparatus including an accumulating section that forms a web by accumulating a material containing fibers on a mesh belt; a humidifying section arranged downstream of the accumulating section in a web transport direction to humidify the web; a transport section arranged downstream of the humidifying section in the web transport direction to transport the web downstream while peeling off the web from the mesh belt; and a pressure roller arranged downstream of the transport section in the web transport direction to pressurize the web, is known.

In the above-described apparatus, the humidifying section performs humidification toward one surface of the web, and the transport section comes into contact with the one surface of the web to perform transport. However, since the transport section comes into contact with one surface having a larger amount of water, there is a problem that the web sticks to the transport section.

When the web sticks to the transport section, the web may be poorly transported or the web may be damaged.

SUMMARY

According to an aspect of the present disclosure, there is provided a fiber body manufacturing apparatus including: an accumulating section that forms a web by accumulating a material containing fibers on a first transport belt by a dry method; a transport section that transports the web by peeling off a first surface of the web from the first transport belt, and by bringing a second surface of the web, which is a surface opposite to the first surface peeled off from the first transport belt, into contact with a second transport belt; a water-applying section that applies water toward the first surface of the web in a state where the web is in contact with the second transport belt; and a pressurizing section that pressurizes the web to which the water is applied and which is peeled off from the second transport belt.

According to another aspect of the present disclosure, there is provided a fiber body manufacturing unit including: an accumulating section that forms a web by accumulating a material containing fibers on a first transport belt by a dry method; a transport section that transports the web by peeling off a first surface of the web from the first transport belt, and by bringing a second surface of the web, which is a surface opposite to the first surface peeled off from the first transport belt, into contact with a second transport belt; and a water-applying section that applies water toward the first surface of the web which is in contact with the second transport belt.

According to still another aspect of the present disclosure, there is provided a fiber body manufacturing method in a fiber body manufacturing apparatus including an accumulating section having a first transport belt configured to transport a web, a transport section having a second transport belt configured to transport the web, a water-applying section that applies water to the web, and a pressurizing section that pressurizes the web, the method including: an accumulating step of forming the web by accumulating a material containing fibers on the first transport belt by a dry method; a transport step of transporting the web by peeling off a first surface of the web from the first transport belt, and by bringing a second surface of the web, which is a surface opposite to the first surface peeled off from the first transport belt, into contact with the second transport belt; a water-applying step of applying the water toward the first surface of the web which is in contact with the second transport belt; and a pressurizing step of pressurizing the web to which the water is applied and which is peeled off from the second transport belt.

DESCRIPTION OF EXEMPLARY EMBODIMENTS

1. First Embodiment

First, a configuration of a fiber body manufacturing apparatus 100 will be described. The fiber body manufacturing apparatus 100 is an apparatus for manufacturing a sheet-like fiber body S.

Figure 1:
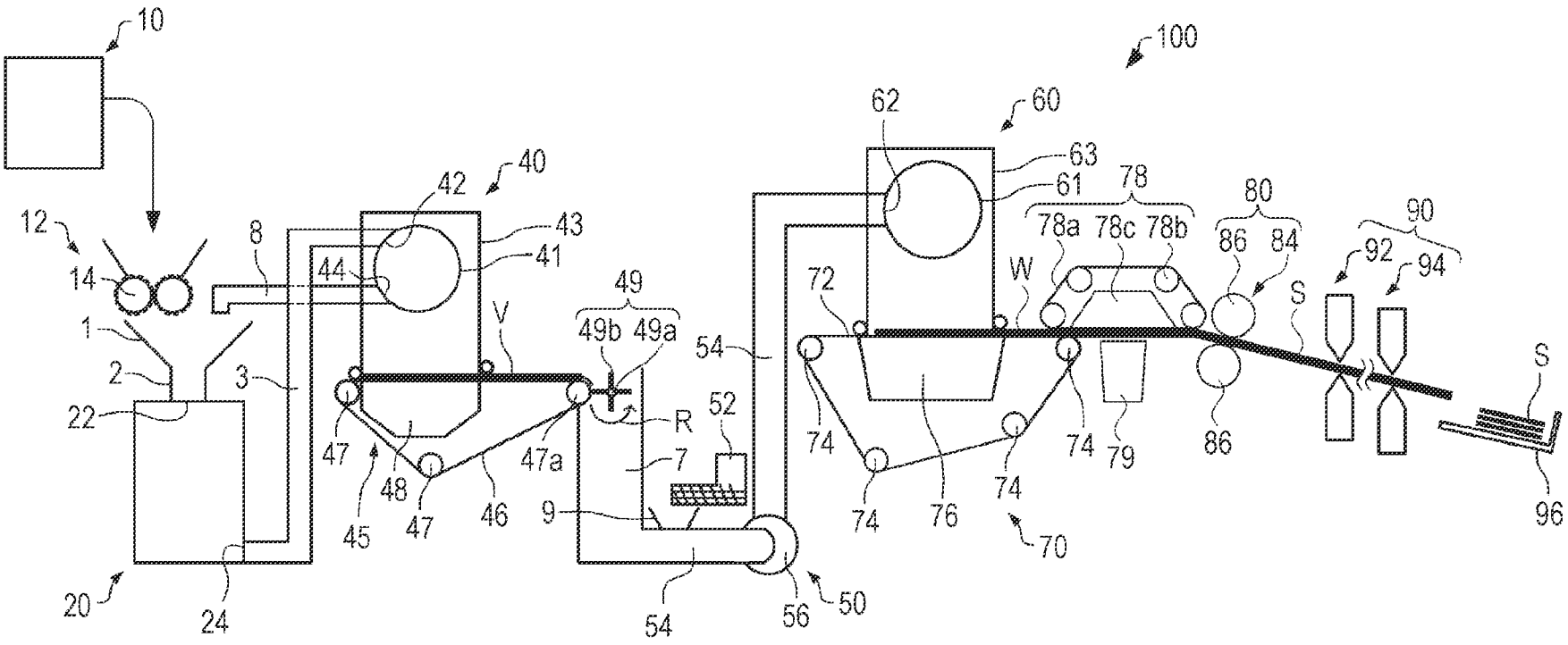
FIG. 1 is a schematic view illustrating a configuration of a fiber body manufacturing apparatus.

As illustrated in FIG. 1, the fiber body manufacturing apparatus 100 includes, for example, a supply section 10, a crushing section 12, a defibration section 20, a sorting section 40, a first web forming section 45, a rotating body 49, a mixing section 50, an accumulating section 60, a second web forming section 70, a transport section 78, a water-applying section 79, a pressurizing section 80, and a cutting section 90.

The supply section 10 supplies the raw material to the crushing section 12. The supply section 10 is, for example, an automatic charging section for continuously charging the raw material into the crushing section 12. The raw material supplied by the supply section 10 is a material containing various fibers.

The fiber is not particularly limited, and a wide range of fiber materials can be used. Examples of the fiber include natural fiber (animal fiber, plant fiber) and chemical fiber (organic fiber, inorganic fiber, organic-inorganic composite fiber). More specifically, the fiber includes fibers made of cellulose, silk, wool, cotton, cannabis, kenaf, flax, ramie, jute, Manila hemp, sisal, coniferous tree, broadleaf tree, and the like, and these may be used alone, may be appropriately mixed and used, or may be used as a purified regenerated fiber.

Examples of the raw material of the fiber include pulp, used paper, and used cloth. Further, the fiber may be subjected to various surface treatments. Further, the material of the fiber may be a pure substance or a material containing a plurality of components such as impurities and other components. Further, as the fiber, a defibrated product obtained by defibrating used paper, pulp sheet, or the like by a dry method may be used.

The length of the fiber is not particularly limited, but in a case of one independent fiber, the length along the longitudinal direction of the fiber is 1 μm or more and 5 mm or less, preferably 2 μm or more and 3 mm or less, and more preferably 3 μm or more and 2 mm or less.

In the fiber body manufacturing apparatus 100, water is applied in the water-applying section 79, and thus the mechanical strength of a formed fiber body S can be increased by using a fiber having the ability to form hydrogen bonds. Examples of such fibers include cellulose.

The fiber content in the fiber body S is, for example, 50% by mass or more and 99.9% by mass or less, preferably 60% by mass or more and 99% by mass or less, and more preferably 70% by mass or more and 99% by mass or less. Such a content can be obtained by performing mixing when forming the mixture.

The crushing section 12 cuts the raw material supplied by the supply section 10 into strips in the air such as the atmosphere. The shape and size of the strips are, for example, several centimeter square. In the illustrated example, the crushing section 12 has a crushing blade 14, and the charged raw material can be cut by the crushing blade 14. As the crushing section 12, for example, a shredder is used. The raw material cut by the crushing section 12 is received by a hopper 1 and then transferred to the defibration section 20 through a pipe 2.

The defibration section 20 defibrates the raw material cut by the crushing section 12. Here, "defibrating" means unraveling a raw material obtained by binding a plurality of fibers into each fiber. The defibration section 20 also has a function of separating substances such as resin particles, ink, toner, and a blot inhibitor adhering to the raw material from the fibers.

A product that passed through the defibration section 20 is referred to as "defibrated product". In addition to the unraveled defibrated fiber, the "defibrated product" may include resin particles separated from the fiber when the fiber is unraveled, coloring agents such as ink and toner, or additives such as blot inhibitors and paper strength enhancers. The shape of the unraveled defibrated product is a shape of a string. The unraveled defibrated product may exist in a state of not being entangled with other unraveled fibers, that is, in an independent state, or may exist in a state of being entangled with other unraveled defibrated products to form a mass shape, that is, in a state where a lump is formed.

The defibration section 20 performs defibration by a dry method. Here, the treatment of defibrating or the like in the air such as the atmosphere, not in the liquid, is referred to as a dry method. As the defibration section 20, for example, an impeller mill is used. The defibration section 20 has a function of suctioning the raw material and generating an airflow that discharges the defibrated product. Accordingly, the defibration section 20 can suction the raw material together with the airflow from an introduction port 22 by the airflow generated by itself, perform the defibration treatment, and transport the defibrated product to a discharge port 24. The defibrated product that passed through the defibration section 20 is transferred to the sorting section 40 through the pipe 3. As the airflow for transporting the defibrated product from the defibration section 20 to the sorting section 40, the airflow generated by the defibration section 20 may be used, or an airflow generating apparatus such as a blower may be provided to use this airflow.

The sorting section 40 introduces the defibrated product defibrated by the defibration section 20 from the introduction port 42 and sorts the defibrated product according to the length of the fibers. The sorting section 40 has, for example, a drum section 41 and a housing section 43 that accommodates the drum section 41 therein. As the drum section 41, for example, a sieve is used. The drum section 41 has a net, and can sort out fibers or particles smaller than the size of the mesh opening of the net, that is, a first sorted product passing through the net, and fibers, undefibrated pieces, and lumps larger than the size of the mesh opening of the net, that is, a second sorted product that does not pass through the net. For example, the first sorted product is transferred to the accumulating section 60 through a pipe 7. The second sorted product is returned from the discharge port 44 to the defibration section 20 through a pipe 8. Specifically, the drum section 41 is a cylindrical sieve that is rotationally driven by a motor. As the net of the drum section 41, for example, a wire net, an expanded metal obtained by stretching a metal plate having a cut, or a punching metal in which a hole is formed in the metal plate by a press machine or the like is used.

The first web forming section 45 transports the first sorted product that passed through the sorting section 40 to the pipe 7. The first web forming section 45 includes, for example, a mesh belt 46, a stretching roller 47, and a suction mechanism 48.

The suction mechanism 48 can suction the first sorted product dispersed in the air through the opening of the sorting section 40 onto the mesh belt 46. The first sorted product is accumulated on the moving mesh belt 46 to form a web V.

Passing products that passed through the opening of the sorting section 40 are accumulated on the mesh belt 46. The mesh belt 46 is stretched by the stretching roller 47, and is configured such that the passing products are unlikely to pass therethrough and air is allowed to pass therethrough. The mesh belt 46 moves as the stretching roller 47 revolves. While the mesh belt 46 moves continuously, the passing products that passed through the sorting section 40 are continuously piled up, and accordingly, the web V is formed on the mesh belt 46.

The suction mechanism 48 is provided below the mesh belt 46. The suction mechanism 48 can generate a downward airflow. By the suction mechanism 48, the passing products dispersed in the air by the sorting section 40 can be suctioned onto the mesh belt 46. Accordingly, the discharge speed from the sorting section 40 can be increased.

The web V is formed in a soft and swollen state containing a large amount of air by passing through the sorting section 40 and the first web forming section 45. The web V accumulated on the mesh belt 46 is charged into the pipe 7 and transported to the accumulating section 60.

The rotating body 49 can cut the web V. In the illustrated example, the rotating body 49 has a base portion 49*a* and a protrusion portion 49*b* protruding from the base portion 49*a*. The protrusion portion 49*b* has, for example, a plate-like shape. In the illustrated example, four protrusion portions

49*b* are provided, and four protrusion portions 49*b* are provided at equal intervals. By rotating the base portion 49*a* in a direction R, the protrusion portion 49*b* can rotate around the base portion 49*a* as an axis. By cutting the web V by the rotating body 49, for example, the fluctuation of the amount of the defibrated product per unit time supplied to the accumulating section 60 can be reduced.

The rotating body 49 is provided in the vicinity of the first web forming section 45. In the illustrated example, the rotating body 49 is provided in the vicinity of the stretching roller 47*a* positioned downstream in the path of the web V. The rotating body 49 is provided at a position where the protrusion portion 49*b* can come into contact with the web V and does not come into contact with the mesh belt 46 on which the web V is accumulated. Accordingly, it is possible to suppress abrasion of the mesh belt 46 by the protrusion portion 49*b*. The shortest distance between the protrusion portion 49*b* and the mesh belt 46 is, for example, 0.05 mm or more and 0.5 mm or less. This is the distance at which the mesh belt 46 can cut the web V without being damaged.

The mixing section 50 mixes, for example, the first sorted product that passed through the sorting section 40 and the binder. The mixing section 50 has, for example, a binder supply section 52 that supplies the binder, a pipe 54 for transporting the first sorted product and the binder, and a blower 56. In the illustrated example, the binder is supplied from the binder supply section 52 to the pipe 54 through the hopper 9. The pipe 54 is continuous with the pipe 7.

In the mixing section 50, an airflow is generated by the blower 56, and the first sorted product and the binder can be transported while being mixed in the pipe 54. The mechanism for mixing the first sorted product and the binder is not particularly limited, and may be agitated by a blade that rotates at high speed, or may use rotation of a container such as a V-type mixer.

As the binder supply section 52, a screw feeder, a disc feeder, or the like is used.

The binder supplied from the binder supply section 52 is, for example, starch or dextrin. Starch is a polymer in which a plurality of a-glucose molecules are polymerized by glycosidic bonds. The starch may be linear or may contain branches.

As the starch, those derived from various plants can be used. Raw materials for starch include grains such as corn, wheat, and rice, beans such as broad beans, mung beans, and red beans, tubers such as potatoes, sweet potatoes, and tapioca, wild grasses such as *Erythronium japonicum*, bracken, and kudzu, and palms such as sago palm.

Further, processed starch or modified starch may be used as the starch. Examples of the processed starch include acetylated adipic acid cross-linked starch, acetylated starch, oxidized starch, octenyl succinate starch sodium, hydroxypropyl starch, hydroxypropylated phosphoric acid cross-linked starch, phosphorylated starch, phosphoric acid esterified phosphoric acid cross-linked starch, urea phosphorylated esterified starch, sodium starch glycolate, and high amylose corn starch. Further, as the dextrin that serves as the modified starch, those obtained by processing or modifying the starch can be preferably used.

In the fiber body manufacturing apparatus 100, by using starch or dextrin as a binder, at least one of gelatinization of the binder and hydrogen bonds between the fibers occurs by being pressurized and heated after water is applied, and the fiber body S can be given sufficient strength. Meanwhile, when the fiber body S can be given sufficient strength only by hydrogen bonds between the fibers, the fiber body can be manufactured without using a binder. When the fiber body is manufactured without using the binder, the fiber body manufacturing apparatus 100 may not include the binder supply section 52.

The content of starch or dextrin in the fiber body S is, for example, 0.1% by mass or more and 50% by mass or less, preferably 1% by mass or more and 40% by mass or less, and more preferably 1% by mass or more and 30% by mass or less. Such a content can be obtained by performing mixing when forming the mixture.

In addition, in the binder supply section 52, in addition to the binder, in accordance with the type of the fiber body S to be manufactured, a colorant for coloring the fibers, a coagulation inhibitor for suppressing coagulation of fibers or coagulation of binder, a flame retardant for making fibers and the like unlikely to burn, and the like, may be included. The mixture that passed through the mixing section 50 is transferred to the accumulating section 60 through the pipe 54.

The accumulating section 60 introduces the mixture that passed through the mixing section 50 from an introduction port 62, unravels the entangled defibrated product, and disperses the unraveled defibrated product in the air to make the product fall. Accordingly, the accumulating section 60 can uniformly accumulate the mixture on the second web forming section 70.

The accumulating section 60 has, for example, a drum section 61 and a housing section 63 that accommodates the drum section 61 therein. As the drum section 61, a rotating cylindrical sieve is used. The drum section 61 has a net and makes fibers or particles smaller than the size of the mesh opening of the net, which are contained in the mixture that passed through the mixing section 50, fall. The configuration of the drum section 61 is, for example, the same as the configuration of the drum section 41.

The "sieve" of the drum section 61 may not have a function of sorting a specific object. In other words, the "sieve" used as the drum section 61 means a sieve provided with a net, and the drum section 61 may make all of the mixture introduced into the drum section 61 fall.

The second web forming section 70 accumulates the passing products that passed through the accumulating section 60 to form the web W. The second web forming section 70 includes, for example, a first mesh belt 72 that serves as a first transport belt, a stretching roller 74, and a suction mechanism 76.

Passing products that passed through the opening of the accumulating section 60 are accumulated on the first mesh belt 72. The first mesh belt 72 is stretched by the stretching roller 74, and is configured such that the passing products are unlikely to pass therethrough and air is allowed to pass therethrough. The first mesh belt 72 moves as the stretching roller 74 revolves. While the first mesh belt 72 moves continuously, the passing products that passed through the accumulating section 60 are continuously piled up, and accordingly, the web W is formed on the first mesh belt 72.

The suction mechanism 76 is provided below the first mesh belt 72. The suction mechanism 76 can generate a downward airflow. By the suction mechanism 76, the mixture dispersed in the air by the accumulating section 60 can be suctioned onto the first mesh belt 72. Accordingly, the discharge speed from the accumulating section 60 can be increased. Furthermore, the suction mechanism 76 can form a downflow in the falling path of the mixture, and can prevent the defibrated product and the binder from being entangled during the fall.

As described above, the web W in a soft and swollen state containing a large amount of air is formed by passing through the accumulating section 60 and the second web forming section 70.

Figure 2:
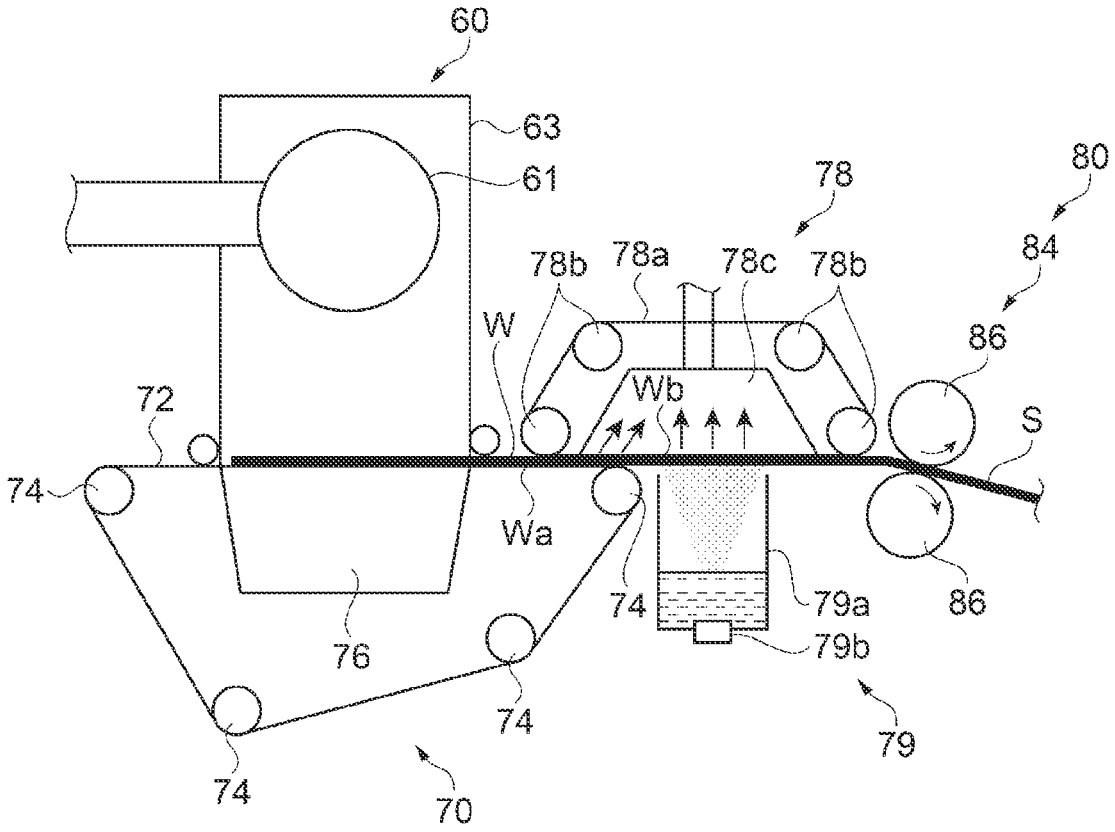
FIG. 2 is a partially enlarged view illustrating a configuration of the fiber body manufacturing apparatus.

The transport section 78 is arranged downstream of the first mesh belt 72 in the transport direction of the web W. The transport section 78 peels off the web W on the first mesh belt 72 from the first mesh belt 72 and transports the web W toward the pressurizing section 80. As illustrated in FIG. 2, the transport section 78 has a second mesh belt 78*a* that serves as a second transport belt, a roller 78*b*, and a suction mechanism 78*c*. The second mesh belt 78*a* is stretched by the roller 78*b*, and is configured such that the air is allowed to pass therethrough. The second mesh belt 78*a* is configured to be movable by the revolution of the roller 78*b*. The suction mechanism 78*c* is arranged at a position facing the web W with the second mesh belt 78*a* interposed therebetween. The suction mechanism 78*c* includes a blower, and generates an upward airflow in the second mesh belt 78*a* by the suction force of the blower. The web W is suctioned by this airflow.

Accordingly, a first surface Wa of the web W is peeled off from the first mesh belt 72, and a second surface Wb which is a surface opposite to the first surface Wa peeled off from the first mesh belt 72 can be adsorbed to the second mesh belt 78*a*. The web W adsorbed to the second mesh belt 78*a* is transported in a state of being in contact with the second mesh belt 78*a*.

The water-applying section 79 is arranged below the transport section 78. The water-applying section 79 applies water toward the first surface Wa of the web W which is in contact with the second mesh belt 78*a*. In the water-applying section 79, as the water, for example, water vapor or mist is applied to the web W. Accordingly, water can be uniformly applied to the web W.

The water-applying section 79 applies water from below the web W toward the first surface Wa. In the present embodiment, a container 79*a* capable of storing water and a piezoelectric vibrator 79*b* arranged at the bottom portion of the container 79*a* are provided. The upper portion of the container 79*a* is opened, and the container 79*a* is arranged such that the opening faces the first surface Wa side of the web W. By driving the piezoelectric vibrator 79*b*, ultrasonic waves are generated in the water and mist is generated in the container 79*a*. The generated mist is supplied to the web W through the opening of the container 79*a*. By applying water from below the web W, water droplets do not fall on the web W even when dew condensation is generated in the water-applying section 79 or in the vicinity thereof. In other words, for example, when water is applied to the web W from above, there is a concern that the water adheres to the water-applying section 79 or the vicinity thereof and falls as water droplets, and the water droplets adhere to the web. In this case, the application of water to the web W becomes non-uniform. However, in the present embodiment, the falling of water droplets and the like is suppressed, and it is possible to avoid affecting the quality of the fiber body S.

Further, the suction mechanism 78*c* of the transport section 78 is arranged at a position facing the water-applying section 79 with the second mesh belt 78*a* interposed therebetween. Accordingly, the airflow containing water generated in the water-applying section 79 by the suction mechanism 78*c* can pass through the inside of the web W and apply water to the inside of the web W. In other words, the suction mechanism 78*c* is arranged so as to face a part of the first mesh belt 72 of the second web forming section 70 and the container 79*a* of the water-applying section 79. Accordingly, the common suction mechanism 78*c* has a function of peeling off the web W from the first mesh belt 72 and adsorbing the web W to the second mesh belt 78*a* and a function of applying water to the inside of the web W. Therefore, the configuration of the fiber body manufacturing apparatus 100 can be simplified.

In the present embodiment, water is applied from the first surface Wa side opposite to the second surface Wb of the web W which is in contact with the second mesh belt 78*a*, and thus the second surface Wb side can be transported with a weaker adhesive force than the first surface Wa side. Therefore, it is possible to suppress the sticking of the web W, to which the water is applied, to the second mesh belt 78*a*.

The water content of the web W to which water was applied in the water-applying section 79 is preferably 12% by mass or more and 40% by mass or less. With the specified web water content, hydrogen bonds between fibers can be effectively formed and the strength of the fiber body S can be increased. Here, the web W having a water content of 12% by mass or more is generally in a state of being easily attached to the transport section. However, in the present embodiment, water is applied to the web W from the first surface Wa side opposite to the second surface Wb of the web W which is in contact with the second mesh belt 78*a*, and accordingly, even on the web W which is easily attached to the transport section, the sticking to the second mesh belt 78*a* can be suppressed. Further, by specifying the water content of the web W to be 40% by mass or less, the amount of water used can be reduced.

Furthermore, the web W containing a binder (starch or dextrin) is generally in a state of being easily attached to the transport section, but in the present embodiment, even in a case of such a web W, the sticking to the second mesh belt 78*a* is suppressed, the binding force between the fibers is increased by the binder, and the strength of the fiber body S can be increased.

The pressurizing section 80 is arranged downstream of the transport section 78 and the water-applying section 79. The web W to which the water is applied is transported to the pressurizing section 80.

The pressurizing section 80 pressurizes the web W to which the water is applied and which is peeled off from the second mesh belt 78*a*. The pressurizing section 80 of the present embodiment simultaneously pressurizes and heats the web W to which water is applied. Accordingly, the water contained in the web W evaporates after the temperature rises, and the thickness of the web W becomes thin to increase the fiber density. The temperature of the water and the binder rises due to heat, the fiber density increases due to the pressure, and accordingly, the binder is gelatinized, and then the water evaporates to bind the plurality of fibers to each other through the gelatinized binder. Furthermore, the water evaporates due to heat and the fiber density increases due to pressure, and accordingly, the plurality of fibers are bound to each other by hydrogen bonds. Accordingly, it is possible to form the sheet-like fiber body S having better mechanical strength.

The pressurizing section 80 of the present embodiment has a pressurizing heating section 84 that pressurizes and heats the web W. The pressurizing heating section 84 can be configured by using, for example, a heating roller or a heat press molding machine. In the illustrated example, the pressurizing heating section 84 is a pair of heating rollers 86. The number of heating rollers 86 is not particularly limited. The pressurizing heating section 84 can simultaneously pressurize and heat the web W. Further, the configuration of the fiber body manufacturing apparatus 100 can be simplified.

As illustrated in FIG. 1, the cutting section 90 cuts the fiber body S molded by the pressurizing section 80. In the illustrated example, the cutting section 90 includes a first cutting section 92 that cuts the fiber body S in a direction intersecting the transport direction of the fiber body S, and a second cutting section 94 that cuts the fiber body S in a direction parallel to the transport direction. The second cutting section 94 cuts, for example, the fiber body S that passed through the first cutting section 92.

As a result, a single-cut fiber body S having a predetermined size is molded. The cut single-cut fiber body S is discharged to a discharge receiving section 96.

Next, a fiber body manufacturing method will be described.

In the present embodiment, a method for manufacturing the fiber body S by the fiber body manufacturing apparatus 100 will be described.

Figure 3:
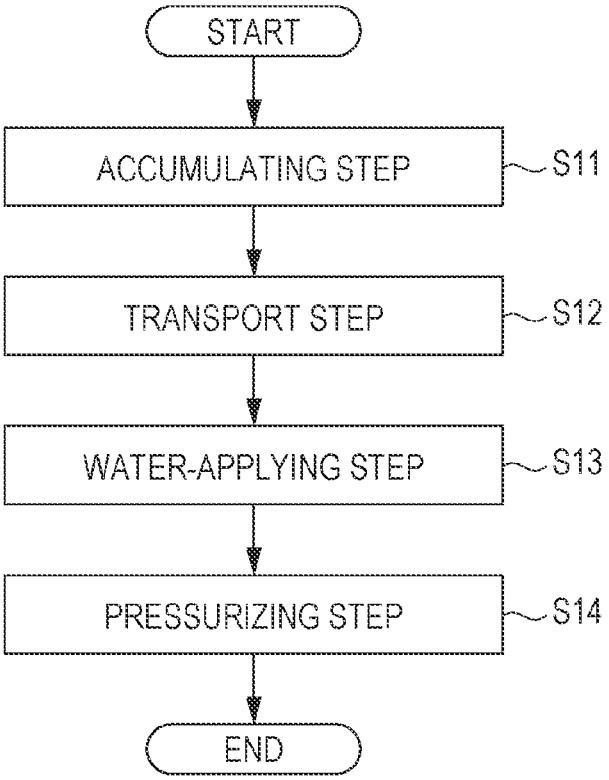
FIG. 3 is a flowchart illustrating a fiber body manufacturing method.

As illustrated in FIG. 3, in the accumulating step (step S11), a material containing fibers is accumulated on the first mesh belt 72 by a dry method to form the web W.

Specifically, a mixture containing defibrated fibers and a binder (starch or dextrin) is accumulated by a dry method to form the web W. The fiber is a defibrated product defibrated by the defibration section 20, the binder is supplied from the binder supply section 52, and the mixture is formed by the mixing section 50. Then, the accumulating section 60 and the second web forming section 70 accumulate the mixture by a dry method to form the web W.

Next, in the transport step (step S12), the first surface Wa of the web W is peeled off from the first mesh belt 72, and the second surface Wb, which is a surface opposite to the first surface Wa peeled off from the first mesh belt 72, is brought into contact with the second mesh belt 78*a* to transport the web W.

Specifically, the suction mechanism 78*c* of the transport section 78 generates an upward airflow in the second mesh belt 78*a* to suction the web W. Accordingly, the first surface Wa of the web W is peeled off from the first mesh belt 72, and the web W is transported in a state where the second surface Wb is in contact with the second mesh belt 78*a*.

Then, in the water-applying step (step S13), water is applied toward the first surface Wa of the web W which is in contact with the second mesh belt 78*a*. In other words, in the present embodiment, water is applied to the web W during the period in which the web W is being transported in the transport step.

Specifically, water is supplied from the water-applying section 79. In this step, water vapor or mist is applied to the web W. By doing so, it is possible to more uniformly apply water to the web W, and the fiber body S can be manufactured with a simpler apparatus configuration. The amount of water applied in the water-applying step can be managed by, for example, the water content of the web W. The water content of the web W to which water was applied in the water-applying step is preferably 12% by mass or more and 40% by mass or less. When the amount of water applied is approximately this level, it is possible to manufacture the fiber body S having higher strength while suppressing the amount of energy such as electric power required for heating and drying the web W.

Further, by applying water toward the first surface Wa side of the web W which is in contact with the second mesh belt 78*a*, the second surface Wb side has a weaker adhesive force than the first surface Wa side, and thus it is possible to suppress the sticking of the web W, to which the water is applied, to the second mesh belt 78*a*.

Then, in the pressurizing step (step S14), water is applied, and the web W peeled off from the second mesh belt 78*a* is pressurized.

Specifically, a pair of heating rollers 86 of the pressurizing section 80 applies pressure to the web W to thin the web and increase the fiber density in the web W. The pressure applied to the web W is preferably 0.1 MPa or more and 15 MPa or less, more preferably 0.2 MPa or more and 10 MPa or less, and further preferably 0.4 MPa or more and 8 MPa or less. When the pressure applied to the web W in the pressurizing step is within such a range, the deterioration of the fiber can be suppressed, and the fiber body S having good strength can be manufactured again using the defibrated product obtained by defibrating the manufactured fiber body S as a raw material.

Further, in the pressurizing step, heat is applied to the web W to evaporate the water contained in the web W. In the pressurizing step, the web W is heated so as to have a temperature of 60° C. or higher and 100° C. or lower. By doing so, the time required for the pressurizing step can be reduced, and the fiber body S can be manufactured with lower energy.

In the pressurizing step, since a relatively low pressure is applied to the web W, a small manufacturing apparatus can be used, and since the damage to the fiber is relatively small, the fiber body S is defibrated again to make it easy to manufacture a new fiber body S.

Further, in the pressurizing step, since the web W is heated to a relatively low temperature, it is easy to form hydrogen bonds between the fibers and it is easy to secure the strength of the fiber body S. Further, since the binder can be gelatinized, the fibers can be bound to each other by the binder, and the strength of the fiber body S can be obtained.

2. Second Embodiment

Next, the configuration of a fiber body manufacturing unit 1000 will be described.

Figure 4:
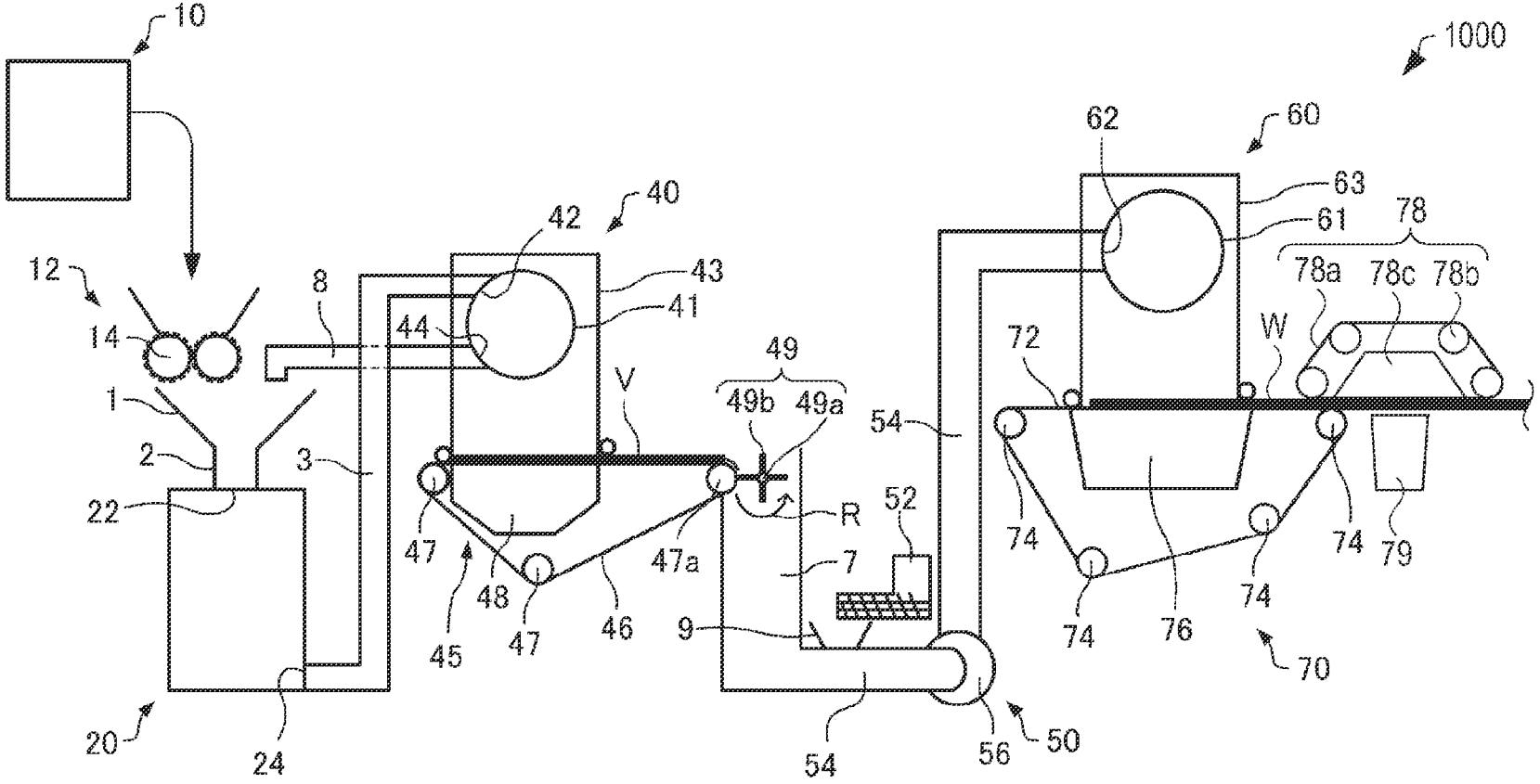
FIG. 4 is a schematic view illustrating a configuration of a fiber body manufacturing unit.

As illustrated in FIG. 4, the fiber body manufacturing unit 1000 includes the accumulating section 60 that forms the web W by accumulating a material containing fibers on the first mesh belt 72 that serves as a first transport belt; the transport section 78 that transports the web by peeling off the first surface Wa of the web W from the first mesh belt 72, and by bringing the second surface Wb, which is a surface opposite to the first surface Wa peeled off from the first mesh belt 72, into contact with the second mesh belt 78*a* that serves as a second transport belt; and the water-applying section 79 that applies water toward the first surface Wa of the web W which is in contact with the second mesh belt 78*a*.

The same configurations as those in the first embodiment will be given the same reference numerals, and repeating description will be omitted.

As described above, the fiber body manufacturing unit 1000 can suppress the sticking of the web W, to which the water is applied, to the second transport belt, as in the above-described embodiment.

In addition to the above-described configuration, the fiber body manufacturing unit 1000 includes, for example, the supply section 10, the crushing section 12, the defibration section 20, the sorting section 40, the first web forming section 45, the rotating body 49, the mixing section 50, and the like.

3. Third Embodiment

Next, a third embodiment will be described.

The same configurations as those in the first embodiment will be given the same reference numerals, and repeating description will be omitted.

In the first embodiment, the configuration in which the web W is brought into contact with the second mesh belt 78*a* and transported by the suction mechanism 78*c* of the transport section 78 was described, but the configuration is not limited thereto, and the configuration that does not include the suction mechanism 78*c* may also be adopted.

Figure 5:
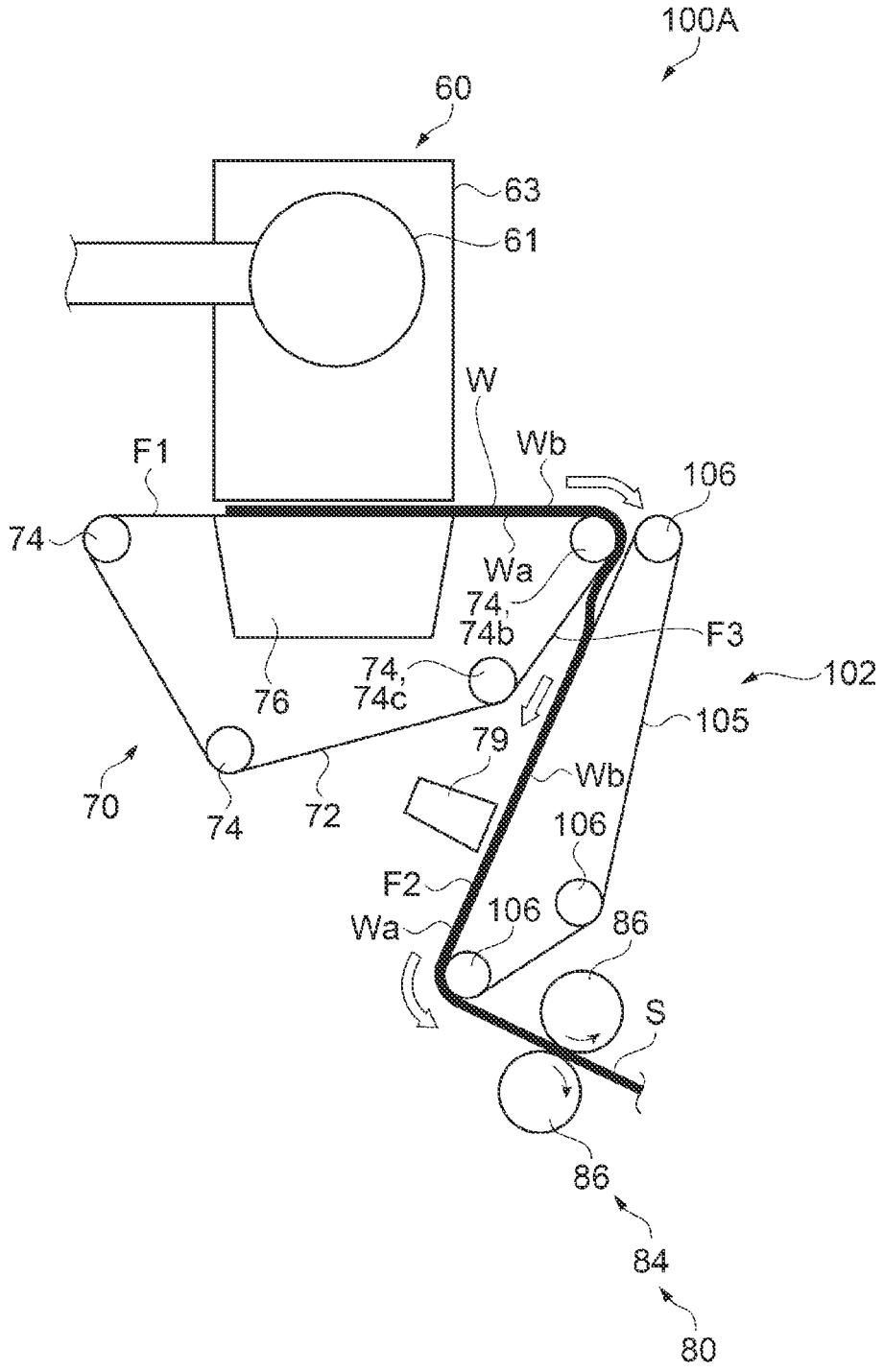
FIG. 5 is a schematic view illustrating a configuration of another fiber body manufacturing apparatus.

As illustrated in FIG. 5, a fiber body manufacturing apparatus 100A of the present embodiment includes the accumulating section 60, the second web forming section 70, a transport section 102, the water-applying section 79, and the pressurizing section 80.

The web W formed on the first mesh belt 72 as the first transport belt is transported by the rotational movement of the first mesh belt 72. Then, the web W transported to the downstream end portion (a part corresponding to a stretching roller 74*b*) of the first mesh belt 72 is transported downward while being stuck to the first mesh belt 72. Here, the angle formed by a first belt surface F1 on the first mesh belt 72 and a third belt surface F3 of the first mesh belt 72 stretched between the stretching roller 74*b* and the stretching roller 74*c* is less than 90 degrees. Therefore, the web W is peeled off from the third belt surface F3 by its own weight. As a result, the web W is delivered from the first mesh belt 72 to the transport section 102 and transported. The transport section 102 is arranged below the first belt surface F1 on the first mesh belt 72.

In the transport section 102, a second mesh belt 105 that serves as a second transport belt stretched by a plurality of stretching rollers 106 is arranged. Then, when at least one of the stretching rollers 106 revolves, the second mesh belt 105 moves in one direction. Then, the web W is delivered from the first belt surface F1 of the first mesh belt 72 to the second belt surface F2 of the transport section 102, and is transported in the transport direction (arrows in the drawing). Here, the transport direction of the second belt surface F2 is downward. At this time, the first surface Wa of the web W is peeled off from the first mesh belt 72, and the second surface Wb which is a surface opposite to the first surface Wa of the web W is transported in a state of being in contact with the second mesh belt 105 of the transport section 102.

The second belt surface F2 is positioned downstream of the first belt surface F1 in the transport direction of the web W. A first angle θ formed by the first belt surface F1 on the first mesh belt 72 and the second belt surface F2 on the second mesh belt 105 is set to be less than 90 degrees.

When the web W accumulated on the first belt surface F1 is transported to the second belt surface F2 side, the web W is peeled off from the first belt surface F1 by its own weight at the end portion (around the area beyond the stretching roller 74*b* in the transport direction) of the first belt surface F1, and is delivered to the second belt surface F2 arranged downward in the vertical direction. Accordingly, when the web W is transported from the first belt surface F1 to the second belt surface F2, equipment such as a suction mechanism and a blade for peeling off the web W is not required at the end portion of the first belt surface F1, and thus the transport configuration can be simplified.

The water-applying section 79 applies water toward the first surface Wa of the web W which is in contact with the second mesh belt 105. The water-applying section 79 is arranged at a position facing the second belt surface F2.

The pressurizing section 80 is arranged downstream of the transport section 102. The pressurizing section 80 pressurizes the web W to which the water is applied and which is peeled off from the second mesh belt 105. The pressurizing section 80 of the present embodiment simultaneously pressurizes and heats the web W to which water is applied.

As described above, according to the present embodiment, as in the above-described embodiment, the second mesh belt 105 supports the second surface Wb which is a surface opposite to the first surface Wa, to which water is applied by the water-applying section 79, and thus it is possible to suppress the sticking of the web W, to which the water is applied, to the second transport belt.

4. Fourth Embodiment

Next, a fourth embodiment will be described.

The same configurations as those in the first embodiment will be given the same reference numerals, and repeating description will be omitted.

In the third embodiment, the upper limit of the first angle θ formed by the first belt surface F1 and the second belt surface F2 is set to less than 90 degrees, but the lower limit of the first angle θ formed by the first belt surface F1 and the second belt surface F2 may be 0 degree.

Figure 6:
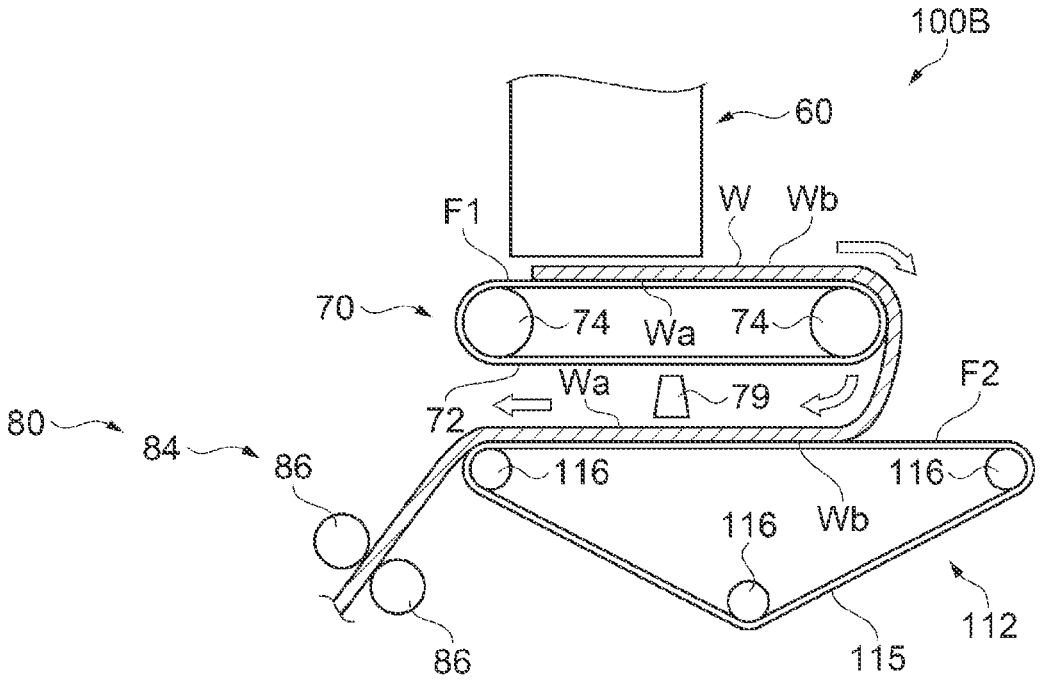
FIG. 6 is a schematic view illustrating a configuration of another fiber body manufacturing apparatus.

As illustrated in FIG. 6, the second web forming section 70 of a fiber body manufacturing apparatus 100B includes the first mesh belt 72 that serves as a first transport belt and two stretching rollers 74 around which the first mesh belt 72 is wound, and is configured to move the first mesh belt 72 in one direction as at least one of the stretching rollers 74 revolves. Further, the transport section 112 is arranged below the second web forming section 70. In addition, the transport section 112 includes the second mesh belt 115 that serves as a second transport belt and a plurality of stretching rollers 116 around which the second mesh belt 115 is wound, and is configured to move the second mesh belt 115 in one direction as at least one of the stretching rollers 116 revolves. Here, the transport section 112 is arranged such that the second belt surface F2 is longer in the horizontal direction than the first belt surface F1 such that the web W transported from the first belt surface F1 can be reliably delivered. Then, the angle made by the first belt surface F1 that transports the web W formed on the first mesh belt 72 and the second belt surface F2 of the second mesh belt 115 that delivers the web W transported from the first belt surface F1 is 0 degree, that is, the first belt surface F1 and the second belt surface F2 are arranged in parallel. Even in this manner, the web W horizontally transported by the first belt surface F1 can be peeled off from the first belt surface F1 by its own weight of the web W at the end portion of the first belt surface F1 and can be delivered by the second belt surface F2 arranged below the first belt surface F1. At this time, the first surface Wa of the web W is peeled off from the first mesh belt 72, and the second surface Wb which is a surface opposite to the first surface Wa of the web W is transported in a state of being in contact with the second mesh belt 115 of the transport section 112.

The water-applying section 79 applies water toward the first surface Wa of the web W which is in contact with the second mesh belt 115. The water-applying section 79 is arranged at a position facing the second belt surface F2. In the present embodiment, water is applied to the web W from above to below.

The pressurizing section 80 is arranged downstream of the transport section 112. The pressurizing section 80 pressurizes the web W to which the water is applied and which is peeled off from the second mesh belt 115. The pressurizing section 80 of the present embodiment simultaneously pressurizes and heats the web W to which water is applied.

As described above, according to the present embodiment, as in the above-described embodiment, it is possible to suppress the sticking of the web W, to which the water is applied, to the second mesh belt 115. Further, since the second web forming section 70 and the transport section 112 can be arranged so as to overlap each other in a plan view, the length of the fiber body manufacturing apparatus 100B in the horizontal direction can be further shortened.

What is claimed is:

1. A fiber body manufacturing apparatus comprising:

a first transport belt on which a material containing fibers and starch for binding the fibers is accumulated;

an accumulating section that faces the first transport belt and forms a web by accumulating the material on the first transport belt by a dry method;

a transport section that includes a second transport belt disposed downstream in a transport direction of the web relative to the first transport belt, the transport section transporting the web by peeling off a first surface of the web from the first transport belt, and by bringing a second surface of the web, which is a surface opposite to the first surface peeled off from the first transport belt, into contact with the second transport belt;

a water-applying section that is disposed below the second transport belt so as to apply water toward the first surface of the web while the web is transported between the water-apply section and the second transport belt, the water-applying section applying the water toward the first surface of the web while the web is in contact with the second transport belt so that a second side surface side of the web is transported with a weaker adhesive force than a first surface side of the web thereby suppressing sticking of the web to the second transport belt; and a pressurizing section that is disposed downstream in the transport direction of the web relative to the transport section, and pressurizes the web to which the water is applied and which is peeled off from the second transport belt.

2. The fiber body manufacturing apparatus according to claim 1, wherein the water-applying section applies water vapor or mist to the web.

3. The fiber body manufacturing apparatus according to claim 1, wherein the transport section further includes a suction mechanism that absorbs the web to the second transport belt.

4. The fiber body manufacturing apparatus according to claim 3, wherein the suction mechanism is arranged at a position facing the water-applying section with the second transport belt interposed therebetween.

5. The fiber body manufacturing apparatus according to claim 1, wherein a water content of the web to which the water is applied is 12% by mass or more and 40% by mass or less.

6. The fiber body manufacturing apparatus according to claim 1, wherein the pressurizing section simultaneously pressurizes and heats the web.

* * * * *